United States Patent [19]

Snyder

[11] Patent Number: 4,691,859

[45] Date of Patent: Sep. 8, 1987

[54] COLLAPSIBLE BULK SHIPPING CONTAINER

[75] Inventor: Teddy R. Snyder, Maumee, Ohio

[73] Assignee: OI Forest Products STS Inc., Toledo, Ohio

[21] Appl. No.: 859,957

[22] Filed: May 5, 1986

[51] Int. Cl.[4] ..... B65D 5/36

[52] U.S. Cl. ..... 229/23 R; 229/41 R; 229/41 B

[58] Field of Search ..... 229/23 R, 41 R, 41 B

[56] References Cited

U.S. PATENT DOCUMENTS

| | | | |
|---|---|---|---|
| 797,201 | 8/1905 | Hale | 229/41 R |
| 1,818,320 | 8/1931 | Gorsuch | 229/41 R |
| 2,534,011 | 12/1950 | Frye | 229/23 R |
| 3,291,364 | 12/1966 | Fischer | 229/23 R |
| 4,373,637 | 2/1983 | Shippell | 229/41 B |
| 4,606,461 | 8/1986 | Bolton, Sr. | 229/41 B |

FOREIGN PATENT DOCUMENTS

| | | |
|---|---|---|
| 1063522 | 8/1959 | Fed. Rep. of Germany . |
| 25995 | of 1907 | United Kingdom . |

OTHER PUBLICATIONS

Reprint from Nov. 19, 1983, edition of Food Processing entitled "Incoming Shipments of Raw Products Packed in . . . Fibre Bins".

*Primary Examiner*—Willis Little
*Attorney, Agent, or Firm*—H. G. Bruss

[57] ABSTRACT

A collapsible, bulk shipping container that is made up of an inverted tray-type rectangular bottom and a collapsible tubular body, one end of which is telescopically received in the tray-type bottom. The collapsible tubular body is collapsible from a fully open position, in which it is rectangular in configuration and in which it fills the tray-type bottom, into a collapsed condition in which it lies against one side of the tray-type bottom, one side of the collapsible tubular body being secured to one side of the tray-type bottom. When the collapsible tubular body has been collapsed, it can be folded over to lie against the tray-type bottom in a compact configuration for ease of the shipment or storage of the bulk shipping container. The tray-type bottom is preferably formed from a unitary blank of corrugated fiberboard, and the collapsible tubular body is preferably formed from a pair of corrugated fiberboard sheets which are joined to one another in an end to end arrangement.

21 Claims, 6 Drawing Figures

COLLAPSIBLE BULK SHIPPING CONTAINER

BACKGROUND OF THE INVENTION

1. Field of the Invention

This invention relates to a collapsible corrugated fiberboard shipping container for shipping relatively large volumes and weights of materials in bulk. A container according to the present invention can be permanently attached to or placed on a conventional wood or plastic pallet or a slip sheet for use and reuse with such pallet or slip sheet, or it can be used and reused without an associated pallet or slip sheet.

2. Description of the Prior Art

Collapsible corrugated fiberboard containers have been proposed for use in the shipment of bulk materials, the collapsibility of such containers permitting the convenient return of such containers to the shipping point, after the emptying of the containers, to permit the reuse of such containers. The volume of such containers is frequently very large, which permits the packaging of large weights of bulk materials therein. Because the weight of the filled container can often be beyond the handling capabilities of the personnel who are engaged in the shipping or other handling of the filled container, it is usually necessary to design the container to be handled by means of a forklift truck. Thus, certain of such collapsible fiberboard containers are designed to be attached to a conventional wood or plastic pallet and to be shipped with the associated pallet in filled condition throughout the movement of the filled container, and to be shipped in collapsed condition with the associated pallet back to the shipping point to permit the reuse of the container. U.S. Pat. Nos. 4,373,637 (Shippell) and 3,291,364 (Fischer) describe collapsible, pallet mounted, corrugated fiberboard shipping containers of the aforesaid type.

Frequently, however, it is desired to provide a collapsible corrugated fiberboard bulk shipping container which can be used independently of a plastic or wood pallet, to avoid the need for accommodating the weight and volume of the pallet in the return of the collapsed container for refilling and reuse. It is possible to mechanically handle a heavy, filled bulk container without having a pallet thereunder, by placing the container on a thin sheet of paper or other sheetlike material, known as a slip sheet, which readily permits a forklift truck tool to engage a free end of the slip sheet to permit the mechanical handling of the filled container. The use of such a slip sheet is described in U.S. Pat. No. 4,153,161 (Taylor, et al.). Collapsible, corrugated fiberboard bulk shipping containers which are designed to be used without associated pallets are shown, for example, in U.S. Pat. Nos. 4,405,077 (Kupersmit) and 4,252,266 (Kupersmit).

SUMMARY OF THE INVENTION

According to the present invention there is provided a collapsible reusable bulk shipping container which can be readily fabricated from singlewall, doublewall or triplewall corrugated fiberboard or from any other suitable foldable, sheetlike material, and which can be used in a form in which it is secured to a wood or plastic pallet, or to a slip sheet, or which can be used independently of such a pallet or such a slip sheet according to the wishes of the user. The bulk container according to the present invention, when erected, has the configuration of a parallelepiped, one surface, the top surface in the normal orientation of the container, being open to permit the filling and emptying of the container. This open top of the container can, of course, if desired, be closed by a separate inverted, tray-type closure which telescopes over the upper portion of the container, or the closure can be formed from flaps that are integrally attached to the container, but the design of such a closure can be conventional, and will not be further described herein.

In any case, the open top, parallelepiped container of the present invention is formed in a pair of separate elements which are then joined together into the assembled collapsible container. The first of the elements is a special, shallow tray-type element which serves as the bottom of the container and which has a rectangular opening that faces upwardly when the container is in its normal orientation. The second of the elements is a collapsible, tubular structure, the bottom portion of which is telescoped into the tray-type element. The tubular structure, when it is fully opened, has four sides, the outside of each of which is adapted to lie adjacent to and substantially coextensive with the inside of one of the four sides of the shallow, tray-type element. The outside of one of the sides of the tubular structure is adhesively or otherwise secured to the inside of the tray-type element that it is adjacent to, and the other three sides of the tubular structure float with respect to, or are unsecured to, the three sides of the tray-type element to which they are adjacent in the erected container. Each of the sides of the tubular structure that extends from an end of the side that is secured to the shallow, tray-type element is foldable along a vertical score line, to permit the collapsing of such sides by the inward folding thereof, an act which draws the fourth side of the tubular structure toward the side that is secured to a side of the tray-type element.

Once collapsed, the tubular structure of the container of the present invention can be folded over from a vertical orientation in its erected condition to a horizontal orientation in its collapsed condition, and the dimensions of the sides of the tubular structure of the container may be such that the tubular structure, when collapsed, in many cases will lie entirely within the periphery of the tray-type element in a neat, compact arrangement. The tubular structure can be formed from a single sheet of corrugated fiberboard, the ends of which are joined together in an overlapping manufacturer's joint by stitching or by bonding, a technique which is similar to that used in regular slotted containers as is known in the art. However, the end to end width of such a single sheet can be rather large in the case of many bulk containers, which frequently have horizontal longitudinal and lateral dimensions of the order of 48″×40″, a standard pallet size and because the end to end width of such a single sheet, can exceed the capabilities of standard equipment on which the sheet is produced, the tubular structure of the container of the present invention is preferably formed from a pair of such sheets joined together end to end with a pair of such manufacturer's joints at the junctures of such sheets.

Accordingly, it is an object of the present invention to provide an improved collapsible bulk shipping container. More particularly, it is an object of the present invention to provide a collapsible, bulk shipping container which can be used with or without an associated pallet according to the wishes of the user. It is also an object of the present invention to provide a reusable, collapsible, multiple component, open-top bulk shipping container which can be fabricated from two or more blanks of a simple configuration, each of which blanks can be formed of a suitable rigid, foldable sheetlike material, the components of such container being secured to one another to avoid disassociation of such components during the return of the collapsed container for reuse. It is also an object of the present invention to provide a collapsible, multi-component, reusable bulk shipping container, which container can be collapsed into a compact configuration that wastes little space during the transportation of such a container in its collapsed condition.

For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
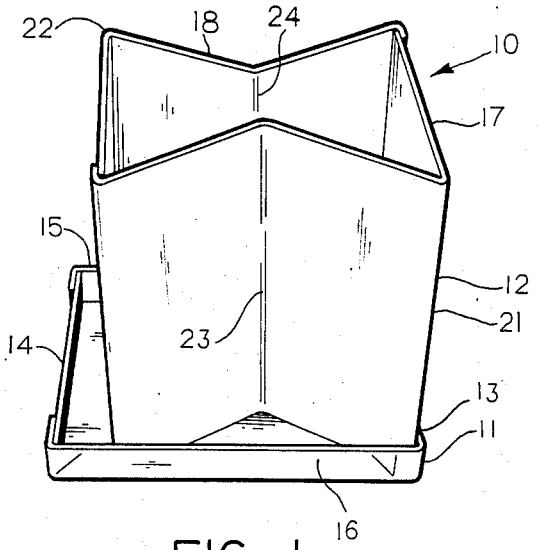
FIG. 1 is a perspective view of a preferred embodiment of a collapsible bulk shipping container in a partially erected state.
Figure 2:
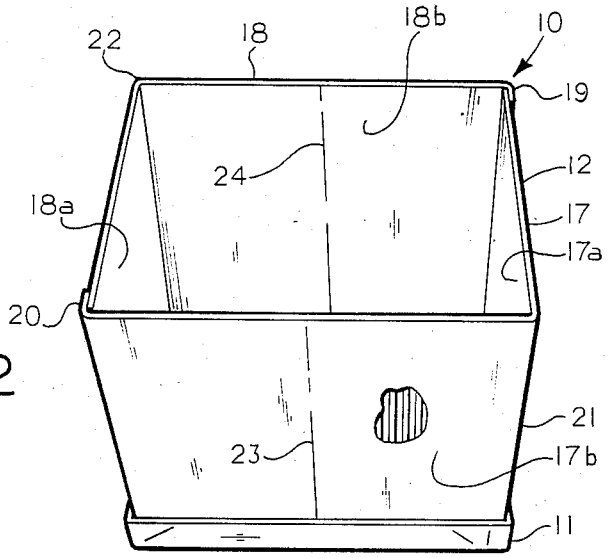
FIG. 2 is a view of the shipping container of FIG. 1 in its fully erected state.
Figure 3:
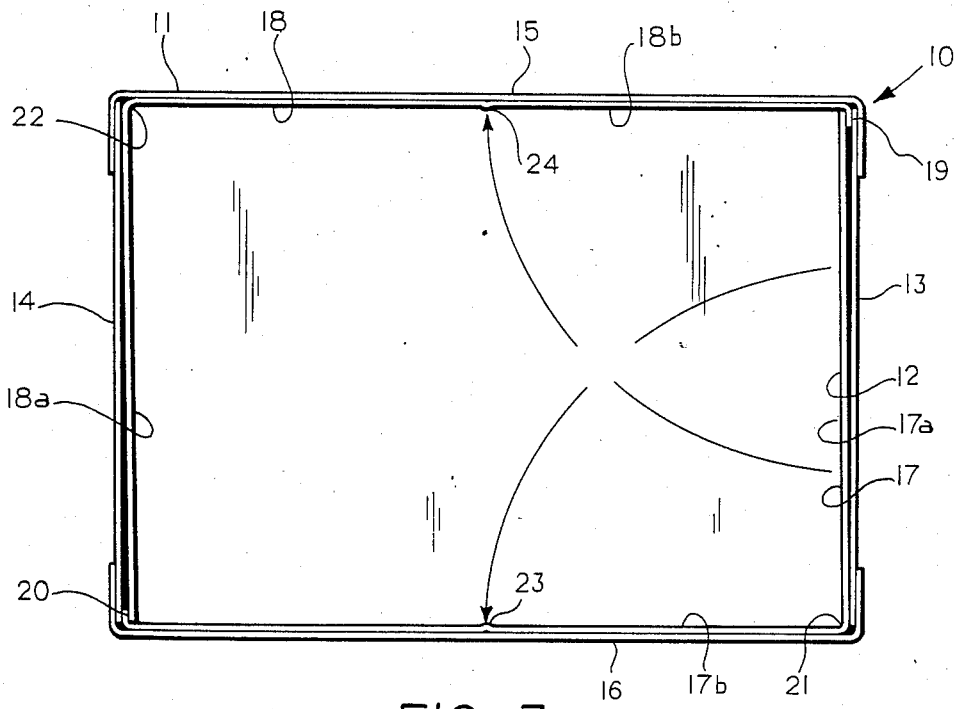
FIG. 3 is a plan view, at an enlarged scale, of the shipping container of the present invention as depicted in FIG. 2.

As is shown in FIG. 1 through 3, a container according to the present invention, identified generally by reference numeral 10, includes a bottom 11 in the form of a tray and a tubular body 12, the bottom portion of which is telescoped into the bottom 11. The bottom 11 of the container 10 is generally quadrilateral in configuration, preferably generally rectangular, and has a pair of opposed short sides 13 and 14 and a pair of opposed long sides 15 and 16, each of the long sides 15 and 16 extending between the opposed ends of the short sides 13 and 14.

The tubular body 12, in the illustrated embodiment, is formed from a pair of sheetlike pieces 17 and 18 joined end to end, with overlapped joints 19 and 20 between the joined ends of the pieces 17 and 18. The sheetlike piece 17 is scored or otherwise deformed along a vertical line 21 to permit it to be folded into an L-shaped configuration, as is shown in FIG. 2, with a short side 17*a* and a long side 17*b*. Similarly, the sheetlike piece 18 is scored or otherwise deformed along a vertical line 22 to permit it to be folded into an L-shaped configuration with a short side 18*a* and a long side 18*b*. When the tubular body 12 is fully erected, as is shown in FIG. 2, its configuration in a horizontal plane is generally rectangular with an opposed pair of short sides formed by the short side 17*a* of the sheetlike piece 17 and the short side 18*a* of the sheetlike piece 18, repsectively, and with an opposed pair of long sides formed by the long side 17*b* of the sheetlike piece 17 and the long side 18*b* of the sheetlike piece 18, respectively. When the tubular body 12 is fully erected, the short side 17*a* of the sheetlike piece 17 will be disposed next to, and will be substantially coextensive with the short side 13 of the bottom 11; the short side 18*a* of the sheetlike piece 18 will be disposed next to, and will be substantially coextensive with the short side 14 of the bottom 11; the long side 17*b* of the sheetlike piece 17 will be disposed next to, and will be substantially coextensive with the long side 16 of the bottom 11; and the long side 18*b* of the sheetlike piece 18 will be disposed next to, and will be substantially coextensive with the long side 15 of the bottom 11.

The tubular body 12 and the bottom 11 of the container 10 are permanently secured to one another along one of the short sides of the bottom 11, shown as the short side 13, by staples, not shown, or by the application of an adhesive, not shown, to the outside of the portion of the short side 17*a* of the sheetlike piece 17 which is overlapped by the short side 13 of the bottom 11 and/or by the application of an adhesive to the inside of the short side 13 of the bottom 11, or in any other conventional manner. The other sides of the tubular body 12, namely the short side 18*a* and the long sides 18*b* and 17*b*, are unsecured to, and are free to move or float with respect to, the sides of the bottom 11 that they are disposed next to, namely the short side 14 and the long sides 15 and 16, respectively.

The long side 17*b* of the sheetlike piece 17 is scored or otherwise deformed along a vertical line 23 which is preferably disposed approximately equidistant the ends of the long side 17*b*, and, similarly, the long side 18*b* of the sheetlike piece 18 is scored or otherwise deformed along a vertical line 24, which is preferably disposed approximately equidistant the ends of the long side 18*b* of the sheetlike piece 18. Thus, by virtue of the deformation of the long side 18*b* of the sheetlike piece 18, the deformation of the long side 17*b* of the sheetlike piece 17, and the fact that the short side 18*a* of the sheetlike piece 18, the long side 17*b* of the sheetlike piece 17, and the long side 18*b* of the sheetlike piece 18 are unsecured to the short side 14 and the long sides 16 and 15, respectively, of the bottom 11, the tubular body 12 can be collapsed within the bottom 11 by moving the short side 18*a* of the sheetlike piece 18 toward the short side 17*a* of the sheetlike piece 17. Such an action will cause the long side 17*b* of the sheetlike piece 17 to fold inwardly about the vertical line 23 as a fold line and will cause the long side 18*b* of the sheetlike piece 18 to fold inwardly about the vertical line 24 as a fold line.

FIG. 1 illustrates the container 10 in which the tubular body 12 is in a partially collapsed state, a state which also corresponds to a partially open state.

Figure 4:
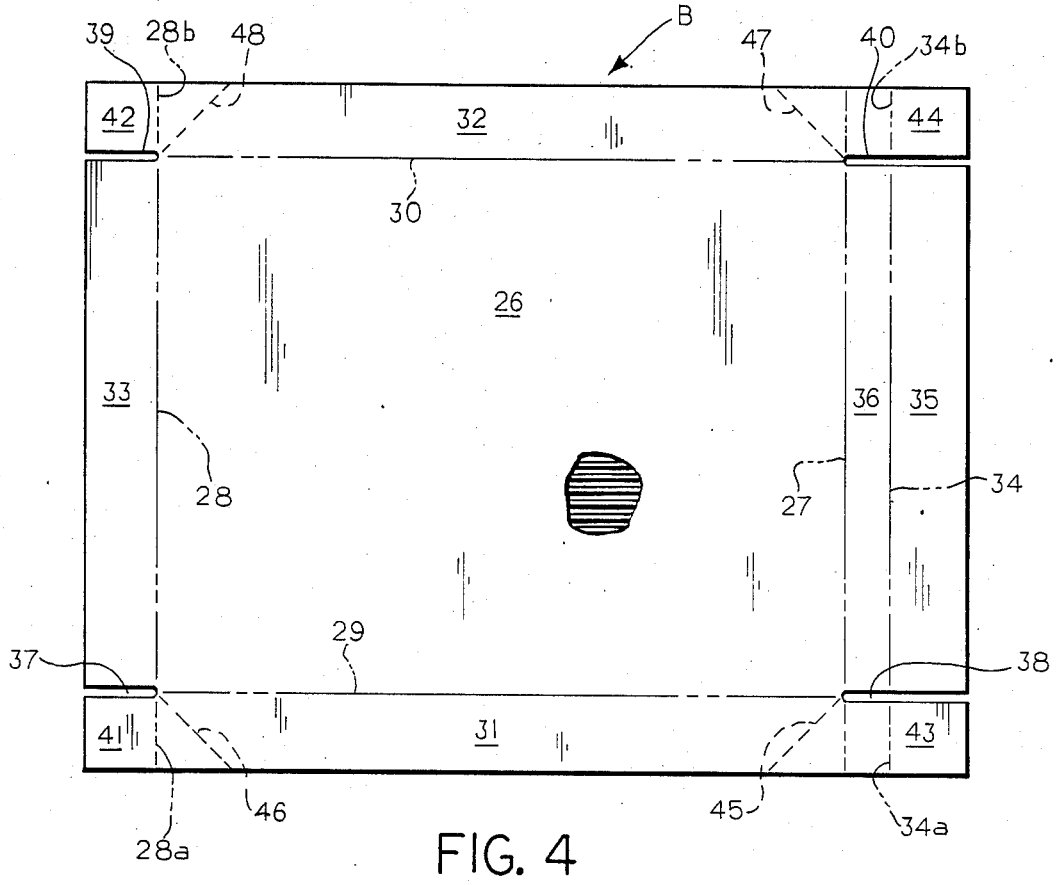
FIG. 4 is a plan view of the top of a blank for use in forming one of the elements of the shipping container depicted in FIGS. 1 through 3.

FIG. 4 illustrates a special blank B from which the bottom 11 of the container 10 is formed. The blank B has a rectangular panel 26 which forms a horizontally disposed lowermost portion of the bottom 11 of the container 10. The rectangular panel 26 is disposed generally centrally within the outline of the blank B, which also is generally of rectangular configuration, and the rectangular panel 26 is separated from the remaining portions of the blank B by fold lines 27 and 28 along the short sides of the rectangular panel 26 and by fold lines 29 and 30 along the long sides of the rectangular panel, the fold lines, 27, 28, 29 and 30 being formed by deforming the blank B by scoring, slit scoring or otherwise, as is known in the art. By the scoring of the blank B along the fold lines 29 and 30 there is formed therein first and second long side panels 31 and 32, respectively, and by the scoring of the blank B along the fold line 28 there is formed a first short side panel 33 in the blank B. The blank B is also scored along a fold line 34 which is spaced from and extends parallel to the fold line 27, the fold line 34 forming a second short panel 35 and an intermediate panel 36 between the fold line 27 and the fold line 34. The blank B is also cut along the extensions beyond fold lines 29 and 30 that lie beyond the ends of the rectangular panel 26 to form slots 37 and 38 at the ends of the fold line 29 and slots 39 and 40 at the ends of the fold line 30. While the slots 38 and 40 are shown as extending from the free edge of the blank B to the fold line 27, it is sufficient in certain embodiments of the invention for them to extend only to the fold line 34. In any case, the blank B is also scored along the extensions of the fold line 28 beyond the fold lines 29 and 30, as shown at 28*a* and 28*b*, respectively, and corner locking flaps 41 and 42 are formed in corners of the blank B by the slot 37 and the fold line extension 28*a*, and by the slot 39 and the fold line extension 28*b*. Thus, the short side 14 and the long sides 15 and 16 of the bottom 11 of the container 10 are formed by folding the first long side panel 31 and the second long side panel 32 to extend normally with respect to the rectangular panel 26, by folding the first short side panel 33 to extend normally with respect to the rectangular panel 26, by inwardly folding the corner locking flaps 41 and 42 to overlie the end portions of the first short side panel 33 and by securing the corner locking flaps 41 and 42 to the portions of the first short side panel 33 by an adhesive or by staples, not shown.

The fold line 34 is also scored along the extension 34*a* and 34*b* which lie beyond the fold lines 29 and 30, thereby forming corner locking flaps 43 and 44 in the other corner of the blank B by the fold line extension 34*a* and the slot 38, and by the fold line extension 34*b* and the slot 40, respectively. Thus, the short side 13 of the bottom 11 of the container 10 is formed by folding the second short panel 35 along the fold line 34 to extend normally with respect to the intermediate panel 36, by inwardly folding the corner locking flaps 43 and 44 to overlie the end portions of the second short side panel 35 and by securing the corner locking flaps 43 and 44 to the portions of the second short side panel 35 by an adhesive or by staples, not shown.

Figure 5:
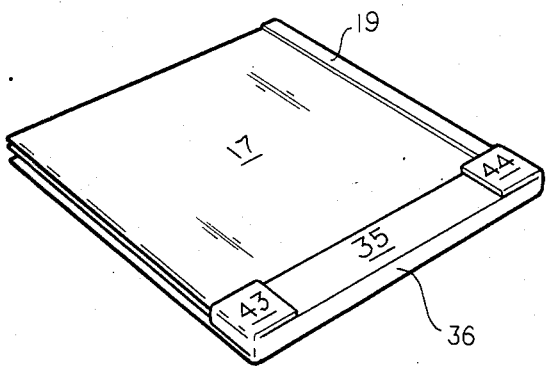
FIG. 5 is a perspective view of the shipping container of FIGS. 1 through 3 in its fully collapsed state.
Figure 6:
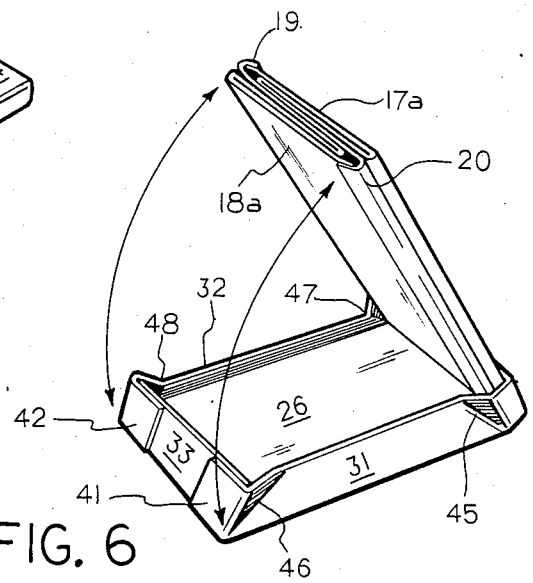
FIG. 6 is a perspective view of the shipping container in FIGS. 1 through 3 and 5 showing a stage in the erection of such shipping container from the fully collapsed state depicted in FIG. 5.

The space between the fold line 27 and the fold line 34 is, preferably, slightly greater than the collapsed thickness of the tubular body 12 of the container so that the end area of the collapsed tubular body 12 can be contained entirely within the outline of the intermediate panel 36. This will permit the collapsed tubular body and the intermediate panel 36 to be folded along the fold line 27 to lie along the rectangular panel 26 of the bottom 11 of the container 20 to permit the container 10 to be collapsed in a neat, compact configuration, as is shown in FIG. 5, for ease of storage and shipment to the packing plant for the first use thereof or, in the case of a reusable container 10, for the return shipment for reuse thereof. For optimum collapsibility the first long side panel 31 is provided with first and second diagonal fold lines 45 and 46 extending, respectively, from the fold lines 27 and 28 in a converging manner, each at a 45° angle to the fold line 29 to the nearby free edge of the blank B, the diagonal fold lines 45 and 46 preferably being formed in the underside of the blank B, and, similarly, the second long side panel 32 is provided with first and second diagonal fold lines 47 and 48 extending, respectively, from the fold lines 27 and 28 in a converging manner, each at a 45° angle to the fold line 30, to the other edge of the blank B, the diagonal fold lines 47 and 48 also, preferably, being formed in the underside of the blank B. The diagonal fold lines 45 and 46 permit the portion of the first long side panel 31 between such diagonal fold lines to be folded inwardly to overlie the rectangular panel 26 when the container 10 is collapsed, and, similarly, the diagonal fold lines 47 and 48 permit the portion of the second long side panel 32 therebetween to be folded inwardly to overlie the rectangular panel 26 when the container 10 is collapsed, as is clear from FIG. 6.

The container 10 can be used with a standard wood or plastic pallet, not shown, for example, by stapling the rectangular panel 26 of the bottom 11 of the container 10 to such pallet or simply by placing or strapping the containers on such pallet. However, the container 10 is not restricted to use with a pallet even in the case of a large container that is adapted to contain heavy loads, for example, a container whose short sides 13 and 14 are each 40" and whose long sides 15 and 16 are each 48", a container size which would be well-suited for use with a standard 40"×48" pallet, because such a container could be handled by standard forklift handling equipment, without being attached to a pallet, for example, by inserting a slip sheet (not shown) thereunder, as is known in the art. While the container 10 as heretofore described has an open top, such open top can, of course, be closed by a separate inverted, telescoping tray-type cover or other cover, not shown, as is known in the art, or it can be closed by flaps that are integrally attached to the tubular body 12, as is also known in the art. The blank B and the sheetlike pieces 17 and 18 of the tubular body 12 are each preferably formed from a heavy load bearing grade or corrugated fiberboard, for example, from heavy singlewall corrugated fiberboard or, preferably, for large containers, such as pallet size 40"×48" containers, from doublewall corrugated fiberboard or even, in certain cases, from triplewall corrugated fiberboard, especially if such large containers are designed to be reusable. Of course, the bottom 11 of the container 10 and the tubular body 12 thereof experience different loads in service. Hence, the grade of corrugated fiberboard that is used in the blank B is not necessarily the same as the grade that is use in the sheetlike pieces 17 and 18.

While the container of the present invention has been described as having the configuration of a rectangle with sides of an unequal length, a configuration which is preferred because it matches the configuration of many pallet sizes and types, it is also contemplated that the container can have the configuration of a rectangle with sides of an equal length, for example, the configuration of a square. Additionally, while the container has been described as having the collapsible body attached to one of the short sides of a tray-type bottom whose configuration is that of a rectangle with sides of an unequal length, the collapsible body can also be attached to one of the long sides of such a tray-type bottom. So long as the height of the tubular body does not exceed the length of the short sides of the tray-type bottom in such an arrangement, the collapsed tubular body will still fit entirely within the perimeter of the bottom panel of the tray-type bottom, and even if the height of the tubular body does exceed the length of the short sides of the tray-type bottom, the only objection is that the collapsed tubular body will extend beyond the side of the tray-type bottom panel that is opposite the side to which it is attached.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A collapsible bulk shipping container comprising:

a tray-type bottom, said tray-type bottom having:

a rectangular bottom panel, said rectangular bottom panel having first and second opposed, spaced-apart short edges and first and second opposed, spaced-apart long edges, said first and second opposed, spaced-apart long edges extending transversely between said first and second opposed, spaced-apart short edges;

first and second long panel means, one of said first and second long panel means being foldably attached to one of said first and second opposed, spaced-apart long edges of said rectangular bottom panel, at least a portion of said one of said first and second long panel means being foldable with respect to said rectangular bottom panel from a first position in which said at least a portion of said one of said first and second long panel means extends generally parallel to said rectangular bottom panel to a second position in which said at least a portion of said one of said first and second long panel means extends generally normally from said rectangular bottom panel, at least a portion of the other of said first and second long panel means being foldably attached to the other of said first and second opposed, spaced-apart long edges of said rectangular bottom panel, said at least a portion of said other of said first and second long panel means being foldable with respect to said rectangular bottom panel from a first position in which said at least a portion of said other of said first and second long panel means extends generally parallel to said rectangular bottom panel to a second position in which said at least a portion of said other of said first and second long panel means extends generally normally from said rectangular bottom panel;

first and second short panel means, one of said first and second short panel means being foldably attached to one of said first and second opposed, spaced-apart short edges of said rectangular bottom panel, said one of said first and second short panel means being foldable, with respect to said rectangular bottom panel, from a first position in which said one of said first and second short panel means extends generally parallel to said rectangular bottom panel to a second position in which said one of said first and second short panel means extends generally normally from said rectangular bottom panel, the other of said first and second short panel means being foldably attached to the other of said first and second opposed, spaced-apart short edges of said rectangular bottom panel; and an intermediate panel, said intermediate panel being directly foldably attached to said one of said first and second opposed, spaced-apart short edges of said rectangular bottom panel, said one of said first and second short panel means being foldably attached to said one of said first and second opposed, spaced-apart short edges of said rectangular bottom panel by being foldably attached to said intermediate panel, said one of said first and second short panel means being foldably attached to said intermediate panel along a fold line which is spaced from and which extends generally parallel to said one of said first and second opposed, spaced-apart short edges of said rectangular bottom panel; and a collapsible tubular structure which is partially telescopically disposed within said tray-type bottom and which is collapsible from a first, open configuration in which said collapsible tubular structure has a generally rectangular configuration to a second, collapsed configuration, said collapsible tubular structure extending generally normally from said rectangular bottom panel of said tray-type bottom when said collapsible tubular structure is in said first, open configuration and in which said collapsible tubular structure, when in said second, collapsed configuration, is foldable with respect to said tray-type bottom to extend generally parallel to said rectangular bottom panel, the space between said fold line of said tray-type bottom and said one of said first and second opposed, spaced-apart short edges of said rectangular bottom panel of said tray-type bottom being substantially at least as great as the thickness of said collapsible tubular structure in its second collapsed configuration so that said collapsible tubular structure when in its second, collapsed configuration, will be contained within the outline of said intermediate panel, said collapsible tubular structure having;

first and second opposed short sides, one of said first and second opposed short sides of said collapsible tubular structure being disposed adjacent to, and being substantially coextensive with, one of said first and second short panel means of said tray-type bottom, said one of said first and second opposed short sides being secured to said one of said first and second short panel means of said tray-type bottom, the other of said first and second opposed short sides being disposed adjacent to, and being substantially coextensive with, the other of said first and second short panel means of said tray-type bottom, when said collapsible tubular structure is in said first, open configuration, said other of said first and second opposed short sides being movable away from said other of said first and second short panel means of said tray-type bottom and toward said one of said first and second opposed short sides upon the collapsing of said collapsible tubular structure into said second, collapsed configuration; and first and second opposed long sides, each of said first and second opposed long sides being foldably attached to and extending between each of said first and second opposed short sides, one of said first and second opposed long sides being disposed adjacent to and being substantially coextensive with one of said first and second long panel means of said tray-type bottom when said collapsible tubular structure is in said first, open configuration, the other of said first and second opposed long sides being disposed adjacent to and being substantially coextensive with the other of said first and second long panel means of said tray-type bottom when said collapsible tubular structure is in said first, open configuration, each of said first and second opposed long sides further having vertical fold line means therein to permit said each of said first and second opposed long sides to be folded inwardly about said vertical fold line means toward the other of said first and second opposed long sides upon the collapsing of said collapsible tubular structure into said second, collapsed configuration.

2. A collapsible bulk shipping container according to claim 1 in which said tray-type bottom is formed from a unitary blank of a foldable sheetlike material.

3. A collapsible bulk shipping container according to claim 2 in which said foldable sheetlike material is corrugted fiberboard.

4. A collapsible bulk shipping container according to claim 3 in which said collapsible tubular structure is formed from a second foldable sheetlike material.

5. A collapsible bulk shipping container according to claim 4 in which said second foldable sheetlike material is corrugated fiberboard.

6. A collapsible bulk shipping container according to claim 5 in which said corrugated fiberboard is multiwall corrugated fiberboard.

7. A collapsible bulk shipping container according to claim 1 in which said collapsible tubular structure is formed from first and second pieces, said first and second pieces being joined end to end into said collapsible tubular structure.

8. A collapsible bulk shipping container according to claim 7 in which one of said first and second pieces of said collapsible tubular structure includes one of said first and second short panel means and one of said first and second long panel means, and in which the other of said first and second pieces of said collapsible tubular structure includes the other of said first and second short panel means and the other of said first and second long panel means.

9. A collapsible bulk shipping container according to claim 8 wherein each of said first and second pieces is formed from a sheet of foldable corrugated fiberboard.

10. A collapsible bulk shipping container according to claim 1 in which each of said first and second long panel means of said tray-type bottom comprises:

first and second spaced-apart diagonal score line means therein to permit the portion of said each of said first and second long panel means between said first and second spaced-apart diagonal fold lines to be folded inwardly into said first position in which said portion extends generally parallel to said rectangular bottom panel of said tray-type bottom when said collapsible tubular structure of said collapsible bulk shipping container, when in its second, collapsed configuration is folded with respect to said tray-type bottom to extend generally parallel to said rectangular bottom panel of said tray-type bottom.

11. A unitary blank for forming a tray-type bottom of a collapsible bulk shipping container, said blank being generally rectangular in configuration and comprising:

a rectangular bottom panel, said rectangular bottom panel having first and second opposed spaced-apart short edges and first and second opposed, spaced-apart long edges, said first and second opposed, spaced-apart long edges extending transversely between said first and second opposed, spaced-apart short edges;

an intermediate panel foldably attached to said rectangular bottom panel along one of said first and second opposed, spaced-apart short edges and first and second opposed, spaced-apart long edges;

first wall panel means foldably attached to said intermediate panel along a fold line that is spaced from and extends generally parallel to said one of said first and second opposed, spaced-apart short edges and said first and second opposed, spaced-apart long edges;

second, third and fourth wall panel means foldably directly attached, respectively, to the others of said first and second opposed, spaced-apart short edges and said first and second opposed, spaced-apart long edges;

each of said first, second, third and fourth wall panel means being foldable with respect to said rectangular bottom panel from a first position which is generally in alignment with said rectangular bottom panel to a second position which is generally normal to said rectangular bottom panel said first, second, third and fourth wall panel means being adapted to form a perimetrical wall surrounding said rectangular bottom panel when said each of said first, second, third and fourth wall panel means is folded with respect to said rectangular bottom panel to said second position; and means for securing said first, second, third and fourth wall means to one another in an end to end array to form said perimetrical wall when said each of said first, second, third and fourth wall panel means has been folded with respect to said rectangular bottom panel to said second position.

12. A unitary blank according to claim 11 in which said unitary blank is formed of a foldable, sheetlike material.

13. A unitary blank according to claim 12 in which said foldable sheetlike material is corrugated fiberboard.

14. A unitary blank according to claim 11 in which said first wall panel means, when said first wall panel means has been folded to said second position, is spaced above said rectangular bottom panel by a distance which is substantially equal to the distance between said fold line and said one of said first and second opposed, spaced-apart short edges and said first and second opposed, spaced-apart long edges, said first wall panel means adapted to form, with said rectangular bottom panel and said intermediate panel, a pocket for receiving an end of a collapsed, collapsible tubular structure for use with said tray-type bottom to form said collapsible bulk shipping container.

15. A unitary blank according to claim 11 in which said intermediate panel is foldably attached to said rectangular bottom panel along one of said first and second opposed, spaced-apart short edges.

16. A unitary blank according to claim 11 in which one of said second, third and fourth wall panel means and an opposed one of said second, third and fourth wall panel means are each provided with first and second spaced-apart diagonal score line means therein to permit the portion between said first and second spaced-apart diagonal score line means of said each of said one of said second, third and fourth wall panel means and said opposed one of said second, third and fourth wall panel means to be folded inwardly to overlie said rectangular bottom panel with respect to the remaining portions of said each of said one of said second, third and fourth wall panel means and said opposed one of said second, third and fourth wall panel means when each of said second, third and fourth wall panel means has been folded to said second position.

17. A collapsible bulk shipping container comprising:

a tray-type bottom, said tray-type bottom having:

a rectangular bottom panel, said rectangular bottom panel having a first pair of opposed, spaced-apart edges and a second pair of opposed, spaced-apart edges, said second pair of opposed, spaced-apart edges extending transversely between said first pair of opposed, spaced-apart edges;

a first pair of panel means, one of said first pair of panel means being foldably attached to one of said first pair of opposed, spaced-apart edges of said rectangular bottom panel, at least a portion of said one of said first pair of panel means being foldable with respect to said rectangular bottom panel from a first position in which said at least a portion of said one of said first pair of panel means extends generally parallel to said rectangular bottom panel to a second position in which said at least a portion of said one of said first pair of panel means extends generally normally from said rectangular bottom panel, at least a portion of the other of said first pair of panel means being foldably attached to the other of said first pair of opposed, spaced-apart edges of said rectangular bottom panel, said at least a portion of said other of said first pair of panel means being foldable with respect to said rectangular bottom panel from a first position in which said at least a portion of said other of said first pair of panel means extends generally parallel to said rectangular bottom panel to a second position in which said other of said at least a portion of said first pair of panel means extends generally normally from said rectangular bottom panel;

a second pair of panel means, one of said second pair of panel means being foldably attached to one of said second pair of opposed, spaced-apart edges of said rectangular bottom panel, said one of said second pair of panel means being foldable, with respect to said rectangular bottom panel, from a first position in which said one of said second pair of panel means extends generally parallel to said rectangular bottom panel to a second position in which said one of said second pair of panel means extends generally normally from said rectangular bottom panel, the other of said second pair of panel means being foldably attached to the other of said second pair of opposed, spaced-apart edges of said rectangular bottom panel; and an intermediate panel, said intermediate panel being directly foldably attached to said one of said second pair of opposed, spaced-apart edges of said rectangular bottom panel, said one of said second pair of panel means being foldably attached to said one of said second pair of opposed, spaced-apart edges of said rectangular bottom panel by being foldably attached to said intermediate panel, said one of said second pair of panel means being foldably attached to said intermediate panel along a fold line which is spaced from and which extends generally parallel to said one of said second pair of opposed, spaced-apart edges of said rectangular bottom panel; and a collapsible tubular structure which is partially telescopically disposed within said tray-type bottom and which is collapsible from a first, open configuration in which said collapsible tubular structure has a generally rectangular configuration to a second, collapsed configuration, said collapsible tubular structure extending generally normally from said rectangular bottom panel of said tray-type bottom when said collapsible tubular structure is in said first, open configuration and in which said collapsible tubular structure, when in said second, collapsed configuration, is foldable with respect to said tray-type bottom to extend generally parallel to said rectangular bottom panel, the space between said fold line of said tray-type bottom and said one of said second pair of opposed, spaced-apart edges of said rectangular bottom panel of said tray-type bottom being substantially at least as great as the thickness of said collapsible tubular structure in its second collapsed configuration so that said collapsible tubular structure, when in its second, collapsed configuration, will be contained within the outline of said intermediate panel, said collapsible tubular structure having;

a first pair of opposed sides, one of said first pair of opposed sides of said collapsible tubular structure being disposed adjacent to, and being substantially coextensive with, one of said second pair of panel means of said tray-type bottom, said one of first pair of opposed sides being secured to said one of said second pair of panel means of said tray-type bottom, the other of said first pair of opposed sides being disposed adjacent to, and being substantially coextensive with, the other of said second pair of panel means of said tray-type bottom when said collapsible tubular structure is in said first, open configuration, said other of said first pair of opposed sides being movable away from said other of said second pair of panel means of said tray-type bottom and toward said one of said first pair of opposed sides upon the collapsing of said collapsible tubular structure into said second, collapsed configuration; and a second pair of opposed sides, each of said second pair of opposed sides being foldably attached to and extending between each of said first pair of opposed sides, one of said second pair of opposed sides being disposed adjacent to and being substantially coextensive with one of said first pair of panel means of said tray-type bottom when said collapsible tubular structure is in said first, open configuration, the other of said second pair of opposed sides being disposed adjacent to and being substantially coextensive with the other of said first pair of panel means of said tray-type bottom when said collapsible tubular structure in in said first, open configuration, each of said second pair of opposed sides further having vertical fold line means therein to permit said each of said second pair of opposed sides to be folded inwardly about said vertical fold line means toward the other of said second pair of opposed sides upon the collapsing of said collapsible tubular structure into said second, collapsed configuration.

18. A collapsible bulk shipping container according to claim 17 in which said collapsible tubular structure is formed from first and second pieces, said first and second pieces being joined end to end into said collapsible tubular structure.

19. A collapsible bulk shipping container according to claim 18 in which one of said first and second pieces of said collapsible tubular structure includes one of said first pair of panel means and one of said second pair of panel means, and in which the other of said first and second pieces of said collapsible tubular structure includes the other of said first pair of panel means and the other of said second pair of panel means.

20. A collapsible bulk shipping container according to claim 19 wherein each of said first and second pieces is formed from a sheet of foldable corrugated fiberboard.

21. A collapsible bulk shipping container according to claim 17 in which each of said second pair of panel means of said tray-type bottom comprises:

first and second spaced-apart diagonal score line means therein to permit the portion of said each of said second pair of panel means between said first and second spaced-apart diagonal fold lines to be folded inwardly into said first position in which said portion extends generally parallel to said rectangular bottom panel of said tray-type bottom when said collapsible tubular structure of said collapsible bulk shipping container, when in its second, collapsed configuration, is folded with respect to said tray-type bottom to extend generally parallel to said rectangular bottom panel of said tray-type bottom.

* * * * *